US005840383A

United States Patent [19]

Kotz et al.

[11] Patent Number: 5,840,383

[45] Date of Patent: Nov. 24, 1998

[54] ELECTROMAGNETIC WAVE REFLECTIVE FABRIC

[75] Inventors: Paul A. Kotz, Greensboro, N.C.; Gary T. Starr, Lynchburg, Va.

[73] Assignee: BGF Industries, Inc., Greensboro, N.C.

[21] Appl. No.: 600,085

[22] Filed: Feb. 12, 1996

[51] Int. Cl.[6] ..... H01Q 15/14

[52] U.S. Cl. ..... 428/35.8; 428/34.5; 428/36.1; 442/364; 442/377; 442/411; 343/912

[58] Field of Search ..... 442/334, 364, 442/377, 411; 428/34.5, 35.8, 36.1; 343/912

[56] References Cited

U.S. PATENT DOCUMENTS

| | | | |
|---|---|---|---|
| 3,251,908 | 5/1966 | Wilenius et al. | 264/1 |
| 3,446,661 | 5/1969 | Andersen | 117/227 |
| 3,956,545 | 5/1976 | Afflerbach et al. | 428/37 |
| 4,171,563 | 10/1979 | Withoos | 29/600 |
| 4,600,634 | 7/1986 | Langer | 428/220 |
| 4,733,246 | 3/1988 | Rubin et al. | 343/912 |
| 4,763,133 | 8/1988 | Takemura et al. | 343/912 |
| 4,889,764 | 12/1989 | Chenoweth et al. | 428/283 |
| 4,939,027 | 7/1990 | Daimon et al. | 428/284 |
| 4,983,452 | 1/1991 | Daimon et al. | 428/287 |
| 5,055,854 | 10/1991 | Gustafsson | 343/912 |
| 5,223,327 | 6/1993 | Bihy et al. | 428/195 |
| 5,338,349 | 8/1994 | Farrar | 106/18.12 |

FOREIGN PATENT DOCUMENTS

| | | | |
|---|---|---|---|
| 59-167103 | 9/1984 | Japan | H01Q 15/16 |
| 60-086902 | 5/1985 | Japan | H01Q 15/14 |
| 60-153607 | 8/1985 | Japan | H01Q 15/14 |
| 60-171804 | 9/1985 | Japan | H01Q 15/14 |
| 60-203004 | 10/1985 | Japan | H01Q 15/14 |
| 60-210010 | 10/1985 | Japan | H01Q 15/16 |
| 60-223206 | 11/1985 | Japan | H01Q 15/16 |
| 60-223305 | 11/1985 | Japan | H01Q 15/16 |
| 60-246105 | 12/1985 | Japan | H01Q 15/16 |
| 60-254803 | 12/1985 | Japan | H01Q 15/16 |
| 60-257604 | 12/1985 | Japan | H01Q 15/16 |
| 61-004304 | 1/1986 | Japan | H01Q 15/14 |
| 61-007705 | 1/1986 | Japan | H01Q 15/16 |
| 1218107 | 8/1989 | Japan . | |
| 2120854 | 12/1983 | United Kingdom | H01Q 15/16 |

*Primary Examiner*—Christopher Raimund
*Attorney, Agent, or Firm*—Rhodes, Coats & Bennett, L.L.P.

[57] ABSTRACT

The present invention is directed to a fabric capable of reflecting electromagnetic waves. The fabric contains metal-coated (preferably aluminum) glass fibers bonded together with sheath-core binder fibers. The glass fibers are typically less than 1¼ inches long and the binder fibers are originally approximately 2 inches long. The glass and binder fibers are thoroughly mixed and spread across a flat surface, such as a conveyor, prior to heating. After heating, the mixture is compressed to form the reflective fabric.

30 Claims, 4 Drawing Sheets

ELECTROMAGNETIC WAVE REFLECTIVE FABRIC

BACKGROUND OF THE INVENTION (1) Field of the Invention

The present invention relates generally to a fabric for reflecting electromagnetic waves and, more particularly, to a fabric capable of being the reflective component for antenna devices, satellite dishes and protective shielding.

(2) Description of the Prior Art

With the advances in communication satellite technology, it is now possible for individual homes to receive satellite transmissions with an antenna having a diameter of 2 feet or less. Such a small antenna size makes the direct reception of satellite transmissions more attractive to the general public, therefore, creating a need for an inexpensive, compact, lightweight antenna reflector surface that can be easily and economically manufactured. Antenna reflectors currently manufactured for home use are generally composed of formed metal sheets and/or glass reinforced laminated layers.

Antenna reflectors formed of metal sheets or wire meshes are expensive to manufacture to desired tolerances. Reflectors made of glass reinforced laminated layers are time consuming and labor intensive to produce. Both of the aforementioned reflectors are not particularly well suited for high volume production and are, therefore, too expensive for the average consumer.

Attempts at making an antenna reflector structure composed almost entirely of plastic materials that can be easily mass produced in a single molding operation have been made. U.S. Pat. No. 3,251,908 discloses a method of making a parabolic reflector utilizing the pressure difference in two chambers to deform a thin, plastic membrane. The plastic membrane is coated with an aluminum film and clamped in place between two chambers. A first and second liquid are pumped into the chambers, the first liquid being a hardened plastic material, which creates a pressure differential between the two chambers that elastically deforms the membrane. The plastic membrane remains attached to the liquid plastic material after the plastic material is hardened. The elastic deformation of the membrane, however, results in internal stress being present when the membrane is bonded to the hardened plastic material. The internal stress may cause the plastic membrane to peel from the hardened plastic or to tear during the deformation.

U.S. Pat. No. 4,171,563 discloses a method of making an antenna reflector using a foil plate in place of a plastic membrane in an attempt to prevent tearing during deformation. Although the foil is less likely to tear during deformation, the metal foil is more expensive, difficult to work with and must be protected from the environment which requires that the reflector surface be further coated.

U.S. Pat. No. 4,733,246 discloses a plastic antenna structure having a laminated reflector. An antenna reflector is disclosed having a laminated reflector surface bonded to a rigid molded support structure. The reflector surface is thermoformable and has at least one metalized layer that is "sandwiched" between the two plastic layers. The laminate material is heated and vacuum formed into an antenna reflector. The use of a thermoformable plastic/metal/plastic laminate does not overcome the additional expense associated with metal foils and laminating both sides of the same.

The electromagnetic wave reflecting antenna technology primarily uses layering or laminating techniques. Typically, an electrically conductive surface is laminated with or layered on various thermoplastic resin layers, polymer layers or fiberglass layers, among others. Examples include the U.S. Pat. No. 3,446,661 to Anderson (coating with an electrically conductive material), U.S. Pat. No. 5,223,327 to Bihy et al. (coating with an electromagnetically conductive silk screen), Japanese Patent No. 153,607 to Masami Aoki (applying a metallic compound using electrolysis plating), and British Patent No. 2,120,854 to Bateman et al. (vacuum-depositing aluminum on one face of a plastic substrate).

Further attempts have been made to improve antenna reflector surface materials by forming an electromagnetic reflective fabric. Japanese patents 223,305 and 203,004 to Takeshi Ishino disclose a reflector for microwave antennas constructed with a cloth made of high-polymer conductive fiber threads and a material electrically protecting the cloth composite on the inside or a surface of a fiber-reinforced resin. The cloth, the electrically protecting material and a polyester gel coat are layered together to form the reflector. The cloth is formed by knitting or weaving the polymer conductive fiber threads together to form a fabric. Ishino's disclosure provides a flexible fabric reflector but fails to provide a cost effect fabric. Knitting or weaving electrically conductive threads requires expensive conductive threads or yarns and knitting machines.

Japanese patent 1,218,107 owned by Sumitomo Electronics discloses a conductive fiber-woven cloth formed from a conductive polymer, such as graphite. The cloth forming requires treating with benzine by a CVD method and then baking at 2800° Celsius, followed by impregnating it with an epoxy resin. This technique is obviously impractical.

Japanese patents 223,206, 246,105 and 171,804 to Kengi Takemura disclose a reflector plate for circular polarized wave antennas constructed with a metallic forming laminated between a thermoplastic resin layer and a polymer layer. The patents disclose an intricate metallic meshing or netting layer which is difficult and expensive to manufacture.

Recent attempts at making a reflective fabric using aluminum coated glass fibers bonded together with an adhesive spray have been made. After the aluminum coated glass fibers are sprayed and allowed to dry, the mat is coated with a resin and molded to shape. The resulting product is less than desirable due to inherent structural weakness and poor uniformity of conductive elements.

Thus, there remains a need for a strong and uniform fabric capable of reflecting electromagnetic waves for use as the reflective component for antenna surfaces or electronic shielding. The reflector material should be easier and less expensive to manufacture, easier to apply to dish structures and easier to send on to reflective dish manufacturers. In particular, a process for manufacturing a reflector material is needed that eliminates multiple layering of various compounds, does not require metal foils, meshing, netting or fabric constructed by knitting or weaving conductive threads.

SUMMARY OF THE INVENTION

The present invention is directed to a fabric capable of reflecting electromagnetic waves. The fabric contains metallic fibers bonded together with binder fibers. Preferably, the fabric contains metal-coated (preferably aluminum) glass fibers bonded together with sheath-core binder fibers. However, the metallic fibers may be solid, hollow or composite. The metallic fibers are typically less than 1¼ inches long and the binder fibers are originally approximately 2 inches long. The glass and binder fibers are thoroughly mixed and spread across a flat surface, such as a conveyor, prior to heating. After heating, the mixture is compressed to form the reflective fabric. The metal coating on the glass fibers form an electromagnetic reflective fabric integrally bonded together.

Accordingly, one aspect of the present invention is to provide an electromagnetic wave reflecting fabric having a plurality of metal-coated glass fibers for reflecting certain electromagnetic waves and a plurality of binder fibers dispersed throughout the glass fibers. The binder fibers have a sheath which is melted sufficiently to bond the glass fibers together. The metal-coated glass fibers and binder fibers form a mat of electrically conductive material capable of reflecting electromagnetic waves. The metal coating may be aluminum, copper, nickel or stainless steel, among others, but are preferably aluminum. The metal-coated glass fibers are typically made of E-glass, C-glass, D-glass or S-glass.

The binder fibers are typically sheath-core fibers made of polyester, bicomponent polyester or polypropylene wherein the sheath has a lower melting point than any temperature adversely affecting the binder fiber core or metal-coated glass fibers.

The glass fibers are preferably 0.75–2.0 inches in length and between 8–40 microns in diameter. The binder fibers are preferably 2 inches in length and approximately 4 denier.

A typical glass fiber/binder fiber mixture is approximately 80% glass fibers and 20% binder fibers. However, the mixture may range from as low as 5% to as high as 80% binder fibers. These mixtures will preferably give the fabric a weight of approximately 0.3–0.5 ounces per square foot and a thickness of at least 0.02 inches.

Another aspect of the present invention is to provide a process for making electromagnetic wave reflecting fabric including the steps of mixing metal-coated glass fibers and binder fibers, heating the mixed metal-coated glass fibers and binder fibers until the binder fibers melt and shaping the mixture of glass fibers and melted binder fibers into a fabric mat.

The process may further include the steps of cross-lapping the metal-coated glass fibers prior to the heating step. The process will often include trimming the fabric mat to desired dimensions after the shaping step. The shaping step typically includes compressing the mixture in order to ensure proper bonding of the mixture to achieve a desired fabric thickness and consistency.

The process may further include spreading the mixture evenly over a conveyor belt prior to the heating step. Alternatively, the mixture may be air-laid along the conveyor to provide a fairly random distribution of fibers.

Still another aspect of the present invention is to provide an electromagnetic wave reflecting fabric formed from the process including the steps of mixing metal-coated glass fibers and binder fibers, heating the mixed metal-coated glass fibers and binder fibers until the sheath of binder fibers melt, and shaping the mixture of glass fibers and binder fibers into a fabric mat. The fabric mat is electrically conductive and capable of reflecting electromagnetic waves.

Still a further aspect of the current invention is to provide an electromagnetic wave reflecting fabric formed from the process including the steps of mixing metal-coated glass fibers and binder fibers, spreading the mixture evenly over a substantially flat work surface, heating the mixed metal-coated glass fibers and binder fibers until the binder fibers melt, and compressing the mixture to ensure proper bonding of the mixture. The resulting fabric forms a flexible mat of electrically conductive material capable of reflecting electromagnetic waves.

Since the fabric mat is flexible, the manufacturer may store and ship the fabric in rolls. The rolls are sent to sheet molding compounders and/or satellite dish manufacturers. A resin is typically added to the fabric prior to molding into satellite antenna dishes, forming a sheet molding compound. Alternatively, the resin may be added to the fabric during the molding process in the form of injection molding or similar means of resin transfer and molding.

The fabric is also useful in many other areas requiring electromagnetic shielding. In particular, the fabric is useful in wire cabling, such as coaxial cable, requiring electromagnetic shielding.

The present invention eliminates the need for metal foils, wire meshing, multiple laminations, knitting or weaving conductive threads, and other disadvantages of the prior art as discussed above. The technological advances disclosed herein will ease the cost and manufacturing difficulties associated with mass producing low-cost reflective fabrics for satellite antenna dishes and other shielding products. Furthermore, the fabric is stronger, more flexible and easier to conform than any electromagnetically reflective fabric available.

DESCRIPTION OF THE PREFERRED EMBODIMENTS

Figure 1:
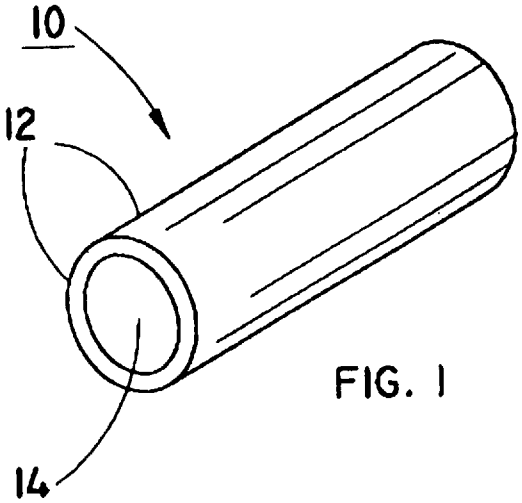
FIG. 1 is an illustration of an aluminum coated glass fiber.
Figure 2:
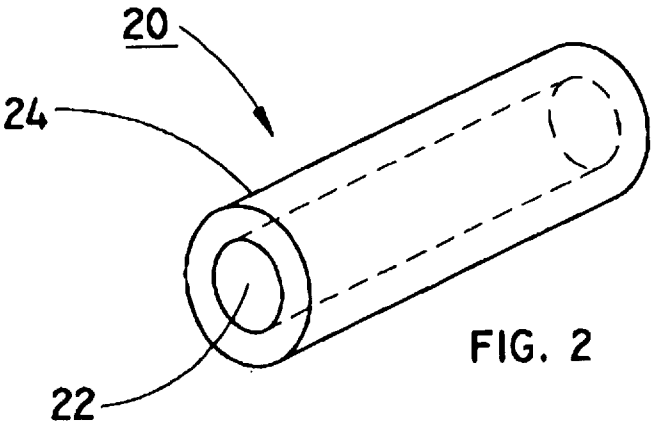
FIG. 2 is an illustration of a sheath-core binder fiber.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general, and FIG. 1 in particular, it will be understood that the illustrations are for the purpose of describing a preferred embodiment of the invention and are not intended to limit the invention thereto. As best seen in FIG. 1, a metal-coated glass fiber, generally designated 10, is shown constructed according to the present invention. The metal-coated glass fiber 10 is made of a cylindrical glass fiber core 14 substantially coated with a metal coating 12. The glass fiber core 14 is preferably made of 95% E-glass (electrical grade glass). C-glass (chemical or corrosion grade glass), D-glass (dielectric glass) and S-glass (high-strength glass) are viable alternatives. The size of the glass fibers 10 will vary according to a particular application, but generally range between 8 and 40 microns in diameter and preferably greater than 0.75 inches in length. Lengths less than 0.75 inches may reduce reflective performance in radio frequency (RF) signal applications.

The metal coating 12 is preferably aluminum, however, copper, nickel or stainless steel, among others, function sufficiently. The coating is generally 1–10 microns thick when using an aluminum coating. The thickness of other metal coatings may vary according to the particular application. The fabric may use a solid or hollow metallic fiber.

The mixture 16 is made up of preferably 80% metal-coated glass fibers 10 and 20% binder fibers 20. Depending on the application, the mixture may consist of 5–80% binder fibers 20. These binder fiber percentages will vary according to the binder fiber 20 material composition, binder characteristics and the particular application.

Figure 3:
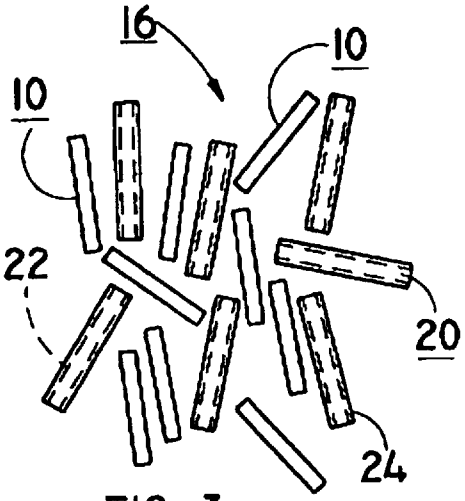
FIG. 3 depicts a mixture of metal-coated glass fibers and binder fibers before melting the binder fiber sheath.

The binder fibers 20 should have a sheath melting point lower than the melting point of the metal-coated glass fibers 10. The binder fibers 20 are preferably made of bicomponent polyester, such as Hoechst Celanese's type 254. Other materials including polyester and polypropylene are also appropriate material for the binder fibers 20. The binder fibers 20 are preferably around 4 denier, however, 2 denier binder fibers are sufficient. Typically, the binder fibers 20 are originally approximately 2 inches in length. The melting point of the sheath 24 of the binder fibers 20 is also lower than any temperature having an adverse effect on the metal coating 12 or the glass fiber core 14 of glass fibers 10. FIG. 3 depicts a mixture 16 of metal-coated glass fibers 10 and binder fibers 20 before heat is applied above the melting point of the sheath 24.

Figure 4:
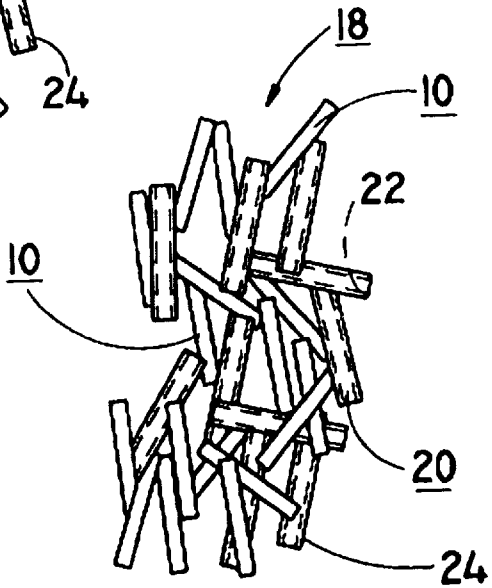
FIG. 4 depicts a fabric formed after the sheath of the binder fibers is melted and bonded to the metal-coated glass fibers.

The sheath 24 of the binder fibers 20 melt as the heat is continually applied to the mixture 16. The melted sheath 24 contacts the metal-coated glass fibers 10. Once cooled, the sheath 24 bonds together the metal-coated glass fibers 10 and the core 22 of the binder fibers 20 to form an electromagnetic wave reflecting fabric 18, as shown in FIG. 4.

Figure 5:
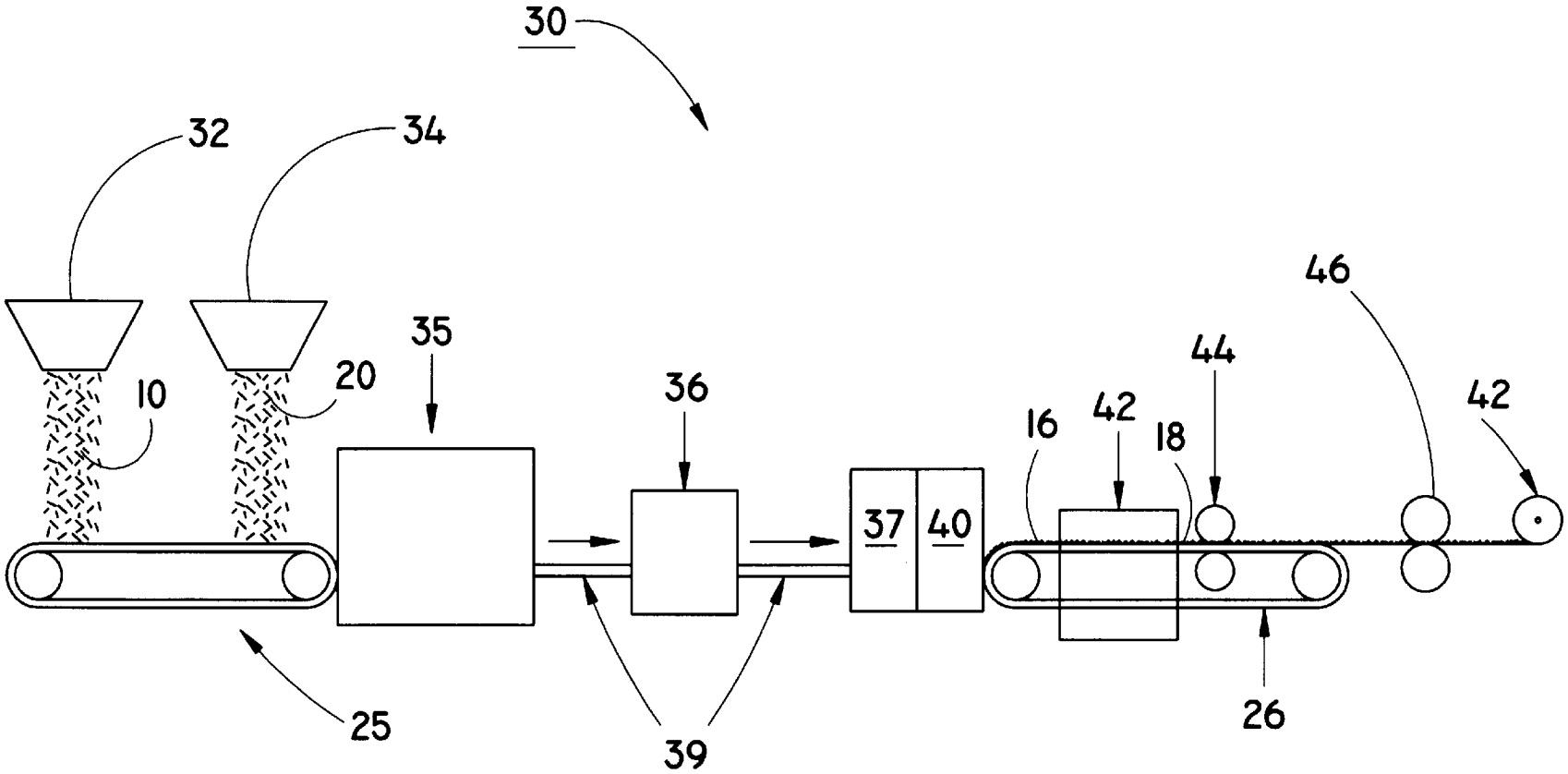
FIG. 5 illustrates a system and process for making fabric using metal-coated glass fibers and binder fibers according to the present invention.

As can be seen in FIG. 5, a fabric processing system, generally designated 30, is shown according to the present invention. A metal-coated glass fiber feed system 32 and binder fiber feed system 34 pours the metal-coated glass fibers 10 and the binder fibers 20 onto a first conveyor 25. The first conveyor 25 transports the fibers to a pre-feeder 35, which pre-blends and separates individual fiber filaments. The fibers 10, 20 are vacuum fed through conduit 39 into a blender 36. The blender 36 blends the fibers 10, 20 together according to a desired blend ratio. The blended fibers form the fiber mixture 16. The fiber mixture 16 is further vacuum fed into a feeder 37 and webber 40. After trimming, the fabric 18 is rolled by winder 48.

The feeder 37 distributes the mixture 16 to the webber system 40. The webber 40 may employ an airstream for air laying the fibers 10, 20 upon a second conveyor 26. An airstream provides a more random fiber 10, 20 distribution. The feeder 37 and webber 40 may also be configured to card and cross-lap the individual fibers on conveyor 26.

The conveyor 26 passes the mixture 16 through an oven 42. The oven 42 may be an infrared oven, a convective through air oven, or a conductive heat transfer oven using a hot roll calendar. The oven 42 generally must heat the mixture 16 between 250°–400° Fahrenheit for 5 to 30 seconds. The temperature and time for heating will vary inversely. As the mixture 16 leaves the oven 42 and begins to cool, the fabric 18 begins to solidify.

While the fabric 18 is still malleable, compression aprons or rolls 44 apply pressure to ensure appropriate bonding and achieve a desired thickness for the fabric 18. After compression, a trimmer 46, preferably formed by multiple circular cutting blades, trims the edges of the fabric 18 to a desired width.

The compressed fabric 18 is generally referred to as a mat 18. The final mat 18 product is preferably 0.3–0.5 ounces per square foot. Higher ratios are limited only by cost. Lower ratios are limited by maintaining sufficient binder strength and electromagnetic wave reflectivity. A lower limit for mat 18 thickness is approximately 0.02–0.2 inches.

Figure 7:
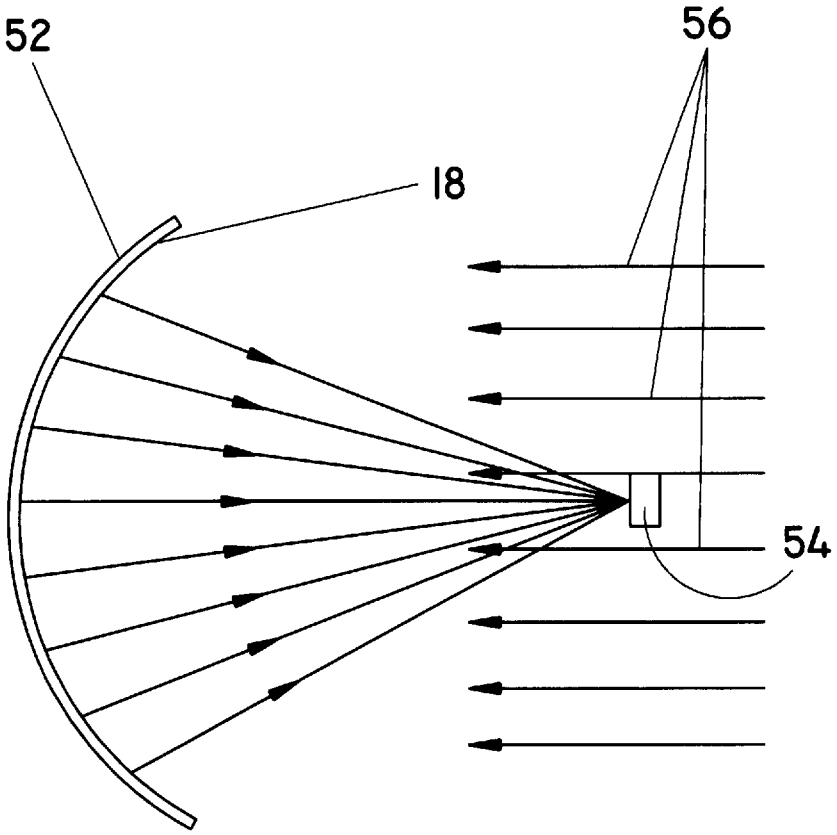
FIG. 7 depicts a cross-section of a satellite dish receiver and illustrates how electromagnetic waves are reflected from the dish surface to a receiver.
Figure 6:
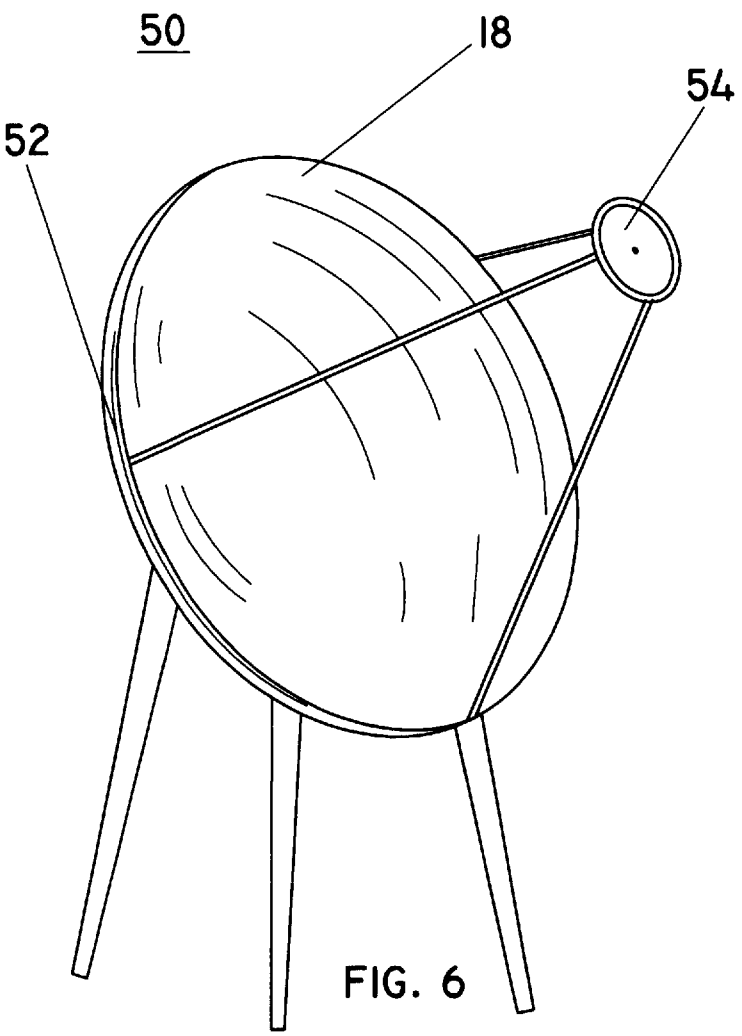
FIG. 6 illustrates a typical antenna dish using a reflective fabric for reflecting electromagnetic waves.

The mat 18 has numerous uses in applications requiring electromagnetic wave reflectivity. FIGS. 6 and 7 illustrate one such application. A satellite dish system, generally designated 50, includes a dish 52 and a receiver or transmitter 54. The dish 52 must reflect electromagnetic waves either into a receiver 54 or from a transmitter (also designated 54). Therefore, the dish must have a component reflective of electromagnetic waves. The mat 18 may form an integral part of the dish 52. As shown in FIG. 7, electromagnetic waves 56 are shown propagating into the dish 52 and reflecting off of mat 18 into the receiver 54.

The mat 18 is typically used as a preform fabric for forming a satellite antenna dish 52. The mat 18 is typically sent in rolls to sheet molding compounders and/or satellite antenna dish manufacturers. Resin is typically added to the mat 18 to form a sheet molding compound. The sheet molding compound is placed in a mold which conforms and molds the mat 18 and resin into a dish 52. Alternatively, resin may be added to the mat during the molding process. The dish 52, depicted in FIG. 7, is made substantially of mat 18 and the resin after the molding process.

Figure 8:
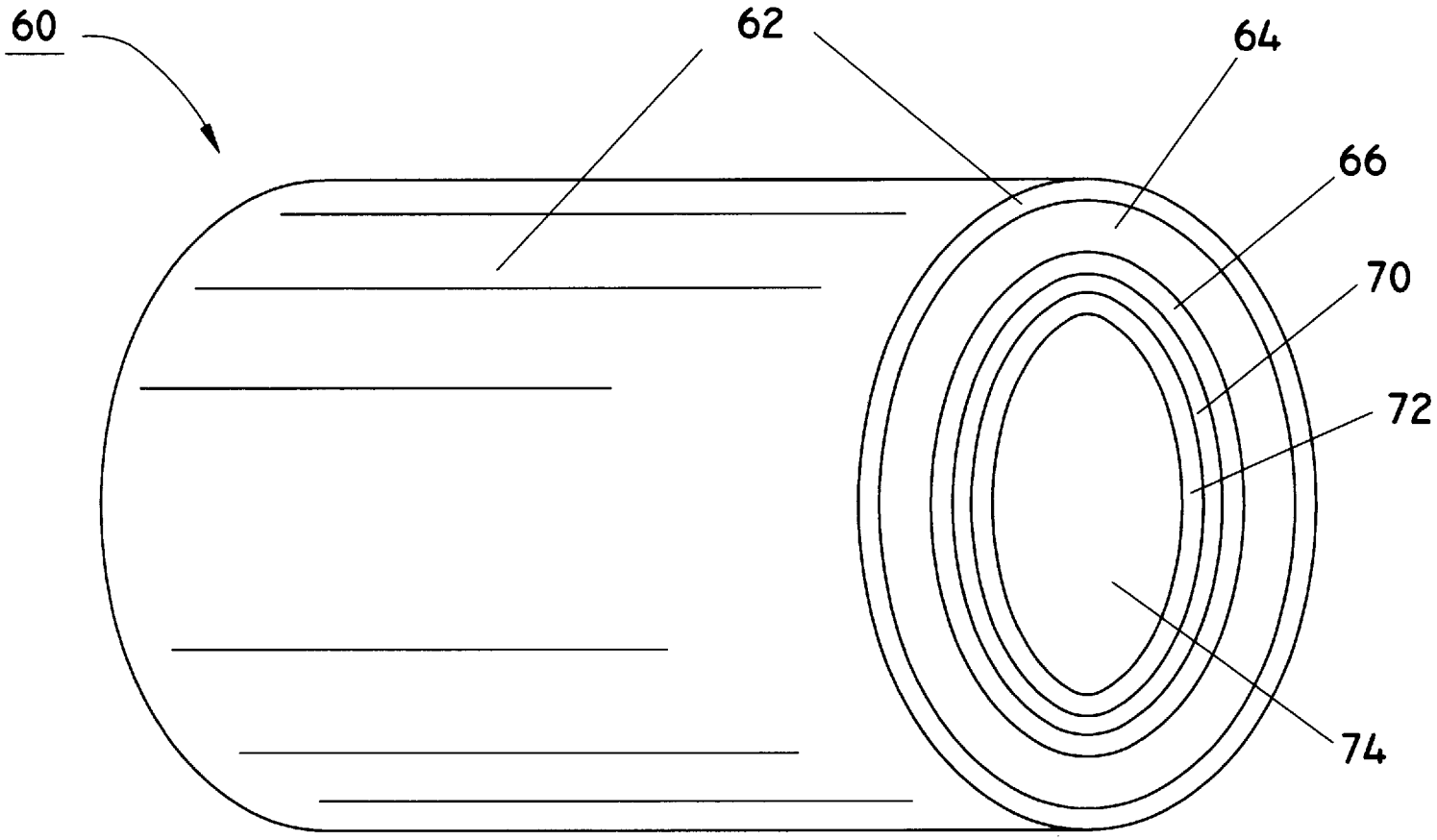
FIG. 8 depicts a shielded coaxial cable embodying the fabric according to the present invention.

Another embodiment of the current invention is shown in FIG. 8. FIG. 8 depicts a shielded coaxial cable, generally designated 60. The coaxial cable includes an outer sheathing 62, a shield 64, an insulator 66, a conductor 70, another insulator 72, and a core conductor 74. The shield 64 is formed with the mat 18. The shield 64 reflects various noise signals emanating from outside of the coaxial cable 50, thereby shielding the internal conductors 70, 74 from the noise signals.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. An electromagnetic wave reflecting fabric compound comprising:

a plurality of metallic fibers for reflecting electromagnetic waves, a plurality of sheath-core binder fibers dispersed throughout said metallic fibers, said binder fibers having a sheath melted sufficiently to bond said metallic fibers and said sheath-core fibers together, a molding resin, and said metallic fibers and said binder fibers form a mat of material capable of reflecting electromagnetic waves, said mat impregnated with said molding resin to form an electromagnetic wave reflective antenna dish.

2. The electromagnetic wave reflecting fabric compound of claim 1 wherein said metallic fibers are glass fibers having a metal coating.

3. The electromagnetic wave reflecting fabric compound of claim 2 wherein said metal-coated glass fibers are coated with a metal selected from the group consisting of aluminum, copper, nickel and stainless steel.

4. The electromagnetic wave reflecting fabric compound of claim 2 wherein said metal-coated glass fibers have an aluminum coating.

5. The electromagnetic wave reflecting fabric compound of claim 1 wherein said binder fibers are selected from the group consisting of polyester, bicomponent polyester and polypropylene.

6. The electromagnetic wave reflecting fabric compound of claim 2 wherein said metal-coated glass fibers are selected from glass consisting of E-glass, C-glass, D-glass and S-glass.

7. The electromagnetic wave reflecting fabric compound of claim 2 wherein said glass fibers are in the range of approximately 8 to 40 microns in diameter.

8. The electromagnetic wave reflecting fabric compound of claim 2 wherein said glass fibers are in the range of approximately 0.75–2.0 inches in length.

9. The electromagnetic wave reflecting fabric compound of claim 1 wherein said binder fibers are in the range of 1.5 to 3.0 inches in length.

10. The electromagnetic wave reflecting fabric compound of claim 1 wherein said binder fibers are approximately two inches in length.

11. The electromagnetic wave reflecting fabric compound of claim 1 wherein said binder fibers are approximately 2 to 4 denier.

12. The electromagnetic wave reflecting fabric compound of claim 1 wherein said sheath of said binder fibers has a melting point lower than said metallic fibers.

13. The electromagnetic wave reflecting fabric compound of claim 1 having approximately 80% metallic fibers with respect to the total weight of metallic fibers and binder fibers exclusive of the molding resin.

14. The electromagnetic wave reflecting fabric compound of claim 1 having between 5 and 80% binder fibers with respect to the total weight of metallic fibers and binder fibers exclusive of the molding resin.

15. The electromagnetic wave reflecting fabric compound of claim 1 having approximately 20% binder fibers with respect to the total weight of metallic fibers and binder fibers exclusive of the molding resin.

16. The electromagnetic wave reflecting fabric compound of claim 1 having a weight of approximately 0.3 to 0.5 ounces per square foot exclusive of the molding resin.

17. The electromagnetic wave reflecting fabric compound of claim 1 having a weight of approximately 0.5 ounces per square foot exclusive of the molding resin.

18. The electromagnetic wave reflecting fabric compound of claim 1 having a thickness of at least 0.02 inches.

19. An electromagnetic wave reflecting fabric compound comprising:

a plurality of metallic fibers for reflecting electromagnetic waves, a plurality of sheath-core binder fibers dispersed throughout said metallic fibers, said binder fibers having a sheath melted sufficiently to bond said metallic fibers and said sheath-core fibers together, a molding resin, and said metallic fibers and said binder fibers being cross-lapped and forming a mat of material capable of reflecting electromagnetic waves, said mat impregnated with said molding resin to form an electromagnetic wave reflective structure.

20. A reflective antenna dish comprising:

metallic fibers for reflecting electromagnetic waves, sheath-core binder fibers dispersed throughout said metallic fibers, said binder fibers having a sheath melted sufficiently to bond said metallic fibers and said binder fibers together, a molding resin, and said metallic fibers and said binder fibers form a reflective fabric compound of the antenna dish, said mat impregnated with said molding resin to form an electromagnetic wave reflective antenna dish.

21. The reflective antenna dish as claimed in claim 20 wherein said reflective component and said resin form a molding compound for molding into said antenna dish.

22. An electromagnetic wave reflecting fabric formed from the process comprising:

mixing metallic fibers and binder fibers;

heating the mixed metal-coated glass fibers and binder fibers until said binder fibers melt;

shaping the mixture of glass fibers and melted binder fibers into a fabric capable of reflecting electromagnetic waves, impregnating a resin into said fabric to form a molding compound; and molding the compound into an antenna dish.

23. The fabric formed in claim 22 wherein said metallic fibers are metal-coated glass fibers.

24. The fabric formed in claim 22 wherein said binder fibers are sheath-core binder fibers.

25. An electromagnetic wave reflecting fabric compound formed from the process comprising:

mixing metallic fibers and binder fibers;

spreading said mixture evenly over a substantially flat work-surface;

heating the mixed metal-coated glass fibers and binder fibers until said binder fibers melt;

compressing the mixture to ensure proper bonding of the mixture thereby forming a flexible mat capable of reflecting electromagnetic waves impregnating a resin into said fabric to form a molding compound; and molding the compound into an antenna dish.

26. The fabric compound formed in claim 25 wherein said metallic fibers are metal-coated glass fibers.

27. The fabric compound formed in claim 25 wherein said binder fibers are sheath-core binder fibers.

28. A sheet molding compound comprising:

a plurality of metallic fibers for reflecting electromagnetic waves, a plurality of binder fibers dispersed throughout said metallic fibers, said metallic fibers and binder fibers forming a reflective fabric, and a resin impregnated in said fabric, wherein said fabric and resin form a sheet molding compound molded into an electromagnetic wave reflective antenna dish.

29. The sheet molding compound of claim 28 wherein said metallic fibers are metal-coated glass fibers.

30. The sheet molding compound of claim 28 wherein said binder fibers are sheath-core binder fibers.

* * * * *